US005449109A

United States Patent [19]

Chuang et al.

[11] Patent Number: 5,449,109

[45] Date of Patent: Sep. 12, 1995

[54] METHOD FOR SUPERPLASTIC FORMING BY INTERNAL PRESSURE

[76] Inventors: Tung-Han Chuang, No. 17-1, Chung-Yuan Rd.,, Tao-Yuan, Taiwan; Jiing-Shin Shyu, No. 502, Shen-Shen Rd., Tung-Liu Li, Yang-Mei Chen, Tao-Yuan Hsien, Taiwan

[21] Appl. No.: 151,855

[22] Filed: Nov. 15, 1993

[51] Int. Cl.[6] ..... B21D 39/00

[52] U.S. Cl. ..... 228/157; 228/235.1; 228/265; 29/421.1; 72/709; 72/62

[58] Field of Search ..... 228/265, 173.6, 157, 228/235.1; 72/60, 61, 62, 63, DIG. 709; 29/421.1, 463

[56] References Cited

U.S. PATENT DOCUMENTS

| | | | |
|---|---|---|---|
| 2,882,588 | 4/1959 | Rieppel | 29/421.1 |
| 3,466,726 | 9/1969 | Savolainen | 29/421.1 |
| 3,807,009 | 4/1974 | Ostbo | 228/157 |
| 4,197,978 | 4/1980 | Kasper | 228/265 |
| 4,538,756 | 9/1985 | Trenkler | 228/157 |
| 4,588,651 | 5/1986 | Israeli | 228/157 |
| 4,811,766 | 3/1989 | Sastry | 228/157 |

FOREIGN PATENT DOCUMENTS

| | | | |
|---|---|---|---|
| 2361215 | 12/1975 | Germany | 228/157 |
| 1206072 | 9/1970 | United Kingdom | 29/421.1 |

*Primary Examiner*—Mark Rosenbaum
*Assistant Examiner*—James Miner
*Attorney, Agent, or Firm*—Michael D. Bednarek; Marks & Murase

[57] ABSTRACT

A high gas pressure material capable of producing 50–300 psi gas pressure at forming temperature is placed in an enclosed area surrounding and sealing the blanks to be superplastically formed, without the use of argon gas. The blanks are formed under tensile stress by the internal pressure produced by the high gas pressure material. The method can be performed concurrently with diffusion bonding to obtain a metallic structure from a plurality of workpieces, and also can be used to manufacture perfectly spherical hollow bodies by a dieless method.

10 Claims, 10 Drawing Sheets

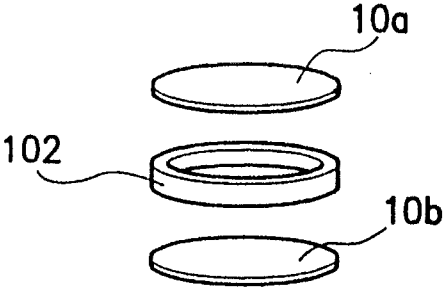
FIG. 10a
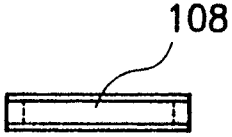
FIG. 10b
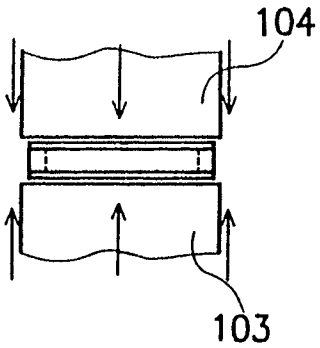
FIG. 10c
FIG. 10d
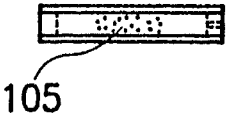
FIG. 10e
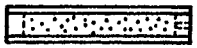
FIG. 10f
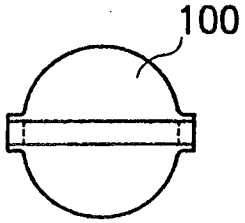
FIG. 10g

METHOD FOR SUPERPLASTIC FORMING BY INTERNAL PRESSURE

BACKGROUND

The present invention relates to a method for superplastic forming by internal pressure.

"Superplasticity" refers to the phenomenon that some materials, when subjecting to a specific strain rate at a specific temperature, exhibit very high tensile elongations and controlled thinning without rupture or necking. Materials having the "superplasticity" property include titanium-based alloy, aluminum-based alloy, copper-based alloy, iron-based alloy and nickel-based alloy. For example, Ti6Al4V alloy and Ti-6Al6V2Sn alloy are superplastic materials which have been extensively used in aircraft materials. 7475Al—Zn—Mg alloy, 2090 Al—Li alloy and 8090 Al—Li alloy are superplastic materials which are now attracting the attention of the aeronautical industry. A large amount of superplastic materials have been rapidly developed. In the "International Symposium on superplasticity of top materials "held in Osaka, Japan in June. 1991, many materials including metal, non-metal, metal composite, structural ceramics, high temperature superconductor ceramics and ceramic composite were reported to possess superplasticity.

The superplastic forming techniques capitalizing on superplasticity of selected materials have many advantages including: very complex shapes and deep drawn parts can be readily formed, less energy is required to work the superplastic forming due to the low deformation stress for forming, thereby minimizing tool deformation and wear. With the above advantages, superplastic forming is considered to be most suitable for processing titanium-based alloys which are conventionally hard to process by known forming techniques.

C. H. Hamilton et al. (U.S. Pat. Nos. 4,181,000; 4,354,369), D. S. Fields et al.(U.S. Pat. No. 3,340,101) and B. B. Hundy (U.S. Pat. No. 3,595,060) disclose methods for superplastic forming metal blanks in which inert gases, for example argon gas, are used to apply fluid pressure loading across the metal blanks when superplastic forming is carried out. The pressure of the argon is about 100–300 psi. D. B. Laycock et al. in their U.S. Pat. No. 4,045,986 disclose a superplastic forming method for shaping superplastic alloy sheet into a finished body having an approximately uniform wall thickness. The method includes applying argon gas to urge a peripherally clamped sheet against a female molding surface to form a partially shaped bubblelike preform and then advancing a male mold toward the sheet from the other side and applying reverse pressure to cause the preform to conform to the shape of that mold. U.S. Pat. No. 3,920,175 issued to C. H. Hamilton discloses a method for making a metal structure by superplastic forming metals with concurrent diffusion bonding. In this method, an inert gas is also used.

As discussed above, conventional methods of superplastic forming involve the use of expensive and high purity argon gas to apply pressure to one side of the metal blank to be superplastic formed. This requires pipelines, flow control values and apparatus for generating pressure, causing an increase in the difficulty of designing the tooling and workpiece structure.

In addition, a German Company, Messerschmitt-Bölkow-Blohm (MBB), has exploited a no-die superplastic forming method for forming hollow spherical bodies. The method includes cutting a Ti6Al4V alloy plate into two disk blanks in which one disk blank is provided with a hole for connecting to a pipe member; bonding the rims of the two disk blanks by welding; and heating the two disk blanks at a temperature of 925° C. while argon gas is instilled into through the pipe member. Hollow spherical bodies are therefore formed without using a die. The above no-die superplastic forming technique has been commercialized.

The above no-die superplastic forming still uses high-cost argon gas and requires connecting welding pipe members to one disk blank for flowing in the argon gas. The finished spherical bodies are therefore not perfectly spherical, sometimes resulting in unacceptable distortion if they are to be used in high precision structural components. Furthermore, welding pipe members for argon gas and cutting off the pipe member after superplastic forming will inevitably increase the manufacturing cost.

SUMMARY OF THE INVENTION

It is therefore an object of the invention to provide a method for superplastic forming a part from a blank, which use no argon gas for applying pressure to the blank.

It is another object of the invention to provide a method for superplastic forming a hollow spherical body, which use no dies or argon gas.

Briefly, according to the invention, a high gas pressure material capable of producing 50–300 psi gas pressure at forming temperature instead of argon gas is placed in an enclosed space surrounded and sealed by the blanks and the shaping member to be superplastically formed. The blanks are formed under tensile stress by the internal pressure produced by the high gas pressure material. The method can be performed concurrently with diffusion bonding to obtain metallic structure from a plurality of workpieces, and also can be used to manufacture perfectly spherical hollow bodies by a no-die method.

BRIEF DESCRIPTION OF THE DRAWINGS

The present invention will be described in detail with reference to the illustrative embodiments and the accompany drawings, in which:

FIG. 10*a*–FIG. 10*g* are schematic diagrams showing two disk blanks and a metal ring being superplastically formed in to a hollow spherical body according to another embodiment of the invention.

DETAILED DESCRIPTION OF THE INVENTION

Figure 1A:
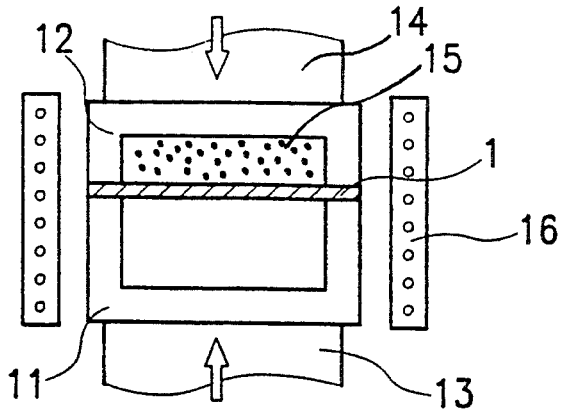
FIG. 1*a*–FIG. 1*c* are schematic diagrams depicting the superplastic forming of a sheet metal blank according to an embodiment of the invention.

According to the invention, high gas pressure material is used to produce an internal pressure when a blank material is to be superplastically formed. Therefore, the high gas pressure material suitable for use in the invention should produce a gas pressure of 50–300 psi at the forming temperature of the blank material. Examples of the high gas pressure material are zinc powder, paraffin and $CaCO_3$. Note that the amount of the high gas pressure material used varies with the material of the blanks, the structure and shape of the finished products, and other parameters, and can be easily determined by those skilled in the art of superplastic forming.

The method of the invention can be applied to any materials which demonstrate superplasticity properties. Some examples of these materials include 7475 aluminum alloy, Ti6Al4V titanium alloy, Ti6Al6V2Sn titanium alloy, and 255 stainless steel.

When the method for superplastic forming according to the invention is to be used to form parts having simple geometry, a blank of superplastic material which exhibits an effective value of strain rate sensitivity at the forming temperature is first provided. The blank is then positioned between a first die having a forming surface which is complementary to the shape of the superplastic forming part and a second die. These dies and the blank are then clamped to enclose an area around the first die, second die and the blank, and the high gas pressure material is placed in the enclosed area. The blank is then heated to the forming temperature to perform superplastic forming and concurrently to permit the high gas pressure material to produce high gas pressure and apply positive internal pressure to the blank to cause the blank to deform against the forming surface of the first die to produce the part.

The method for superplastic forming according to the invention can also be concurrently used with the diffusion bonding technique to fabricate metal structures. In this case, the method is substantially the same as above, except that the metal blank and the workpiece to be diffusion bonded must be heated to a temperature suitable for effecting the superplastic forming and sufficient to produce the diffusion bonding.

Without using a die, the superplastic forming according to the invention can also be applied in the manufacturing of hollow spherical bodies. The procedures include providing 2 disk blanks of superplastic material, placing high gas pressure material between the 2 disk blanks and bonding the rims of the two disk blanks to form a sealed structure, and superplastic forming the two disk blanks. The two disk blanks can be bonded by using arc welding, TIG welding or laser welding. Alternatively, the two disk blanks can be bonded together by sandwiching therebetween a brazing metal ring of the same diameter and then brazing the two disk blanks and the metal ring. If such a brazing metal ring is used, the metal ring must have a melting point above the superplastic forming temperature of the two disk blanks. We can also use a ring of the same material as the disk blanks so that the ring and the two disk blanks can bonded together during the superplastic forming. Also if the ring is of the material that can be diffusion bonded to the disk blanks, the combination must be heated to a temperature sufficient to effect the superplastic forming and the diffusion bonding.

The method for superplastic forming above can be modified to produce hollow spheres by clamping the 2 blanks instead of brazing or welding them.

The method for superplastic forming above can also be modified to produce hollow objects such as hollow spheres by placing 2 dies having the forming surface opposite the 2 blanks and clamping the 2 blanks instead of brazing or welding.

EMBODIMENT 1

Figure 1B:
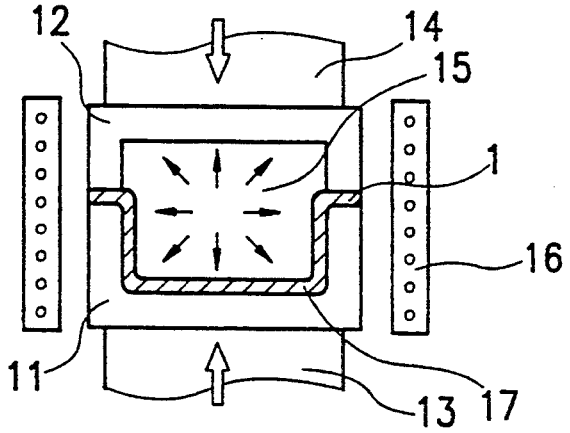
Figure 1C:
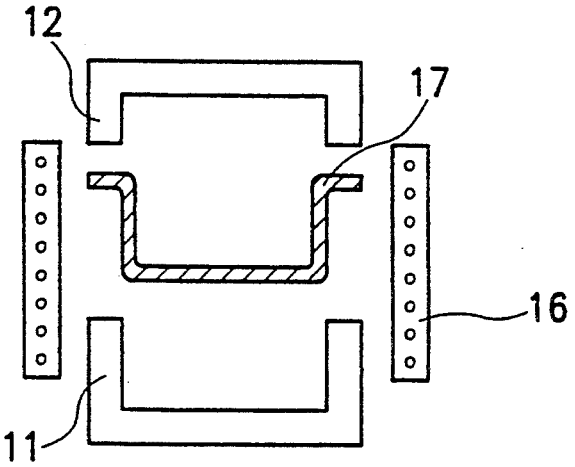
Figure 2D:
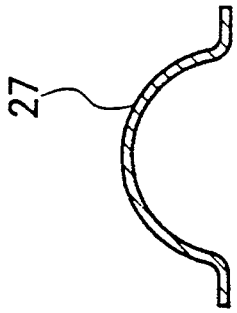
FIG. 2*a*–FIG. 2*d* are schematic diagrams depicting the superplastic forming of a sheet metal blank according to another embodiment of the invention.
Figure 2C:
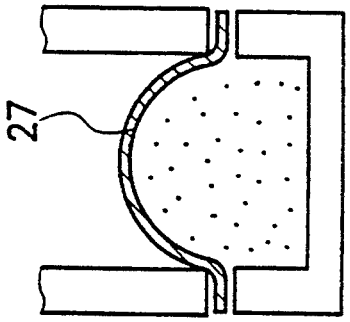
Figure 2B:
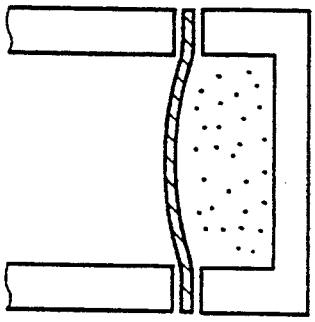
Figure 2A:
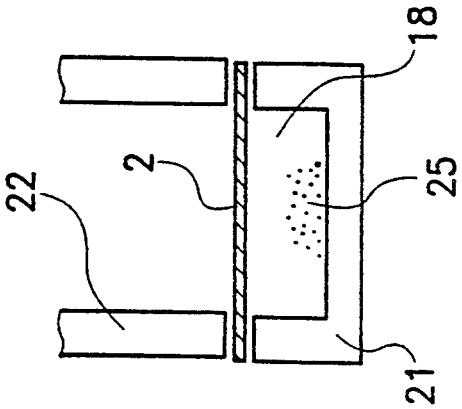

This embodiment illustrates the method of forming a part with a simple geometry, for example a rectangular part. Referring now to FIG. 1*a*, a blank 1 of 7475 aluminium alloy which exhibits an effective value of strain rate sensitivity at 515° C. is positioned between a first die 11 and a second die 12. The first die 11 is connected to a ram 13 while the second die 12 is connected to a ram 14. The blank 1 is clamped between first die 11 and second die 12 by applying pressure using rams 14,13. As can be seen, first die 11 has a forming surface which is complementary to the shape of the finished part 17. Zinc powder 15, which can produce 50–300 psi vapor pressure at 515° C., is preplaced in the area enclosed by blank 1 and second die 12. The blank 1 and the dies 12, 11 are then heated to 515° C. by heater 16 to vaporize zinc powder 15 to apply positive internal pressure to the blank 1 to deform against the forming surface of first die 11 to form the superplastic part 17 as shown in FIG. 1*b*. After the part 17 is formed, the applied pressure is reduced to ambient and the formed part 17 is removed from the dies 12 and 11, as shown in FIG. 1*c*.

EMBODIMENT 2

This embodiment illustrates the method of forming a semispherical workpiece. Referring to FIGS. 2*a*–2*d*, a disk blank 2 of Ti6Al4V alloy (thickness of 1 mm) is clamped by a upper clamping hollow cylinder 22 and a lower clamping hollow cylinder 21. The lower clamping hollow cylinder 21 and the circular blank 2 enclose a space 18 in which a high gas pressure material 25 is preplaced. The high gas pressure material 25 is a mixture of $CaCO_3$ powder (0.4 g) and carbon powder (0.035 g). As can been seen from the FIGS., the blank 2 is deformed into a semispherical workpiece 27 when it is heated to 927° C. for 30 minutes.

EMBODIMENT 3

Figure 3A:
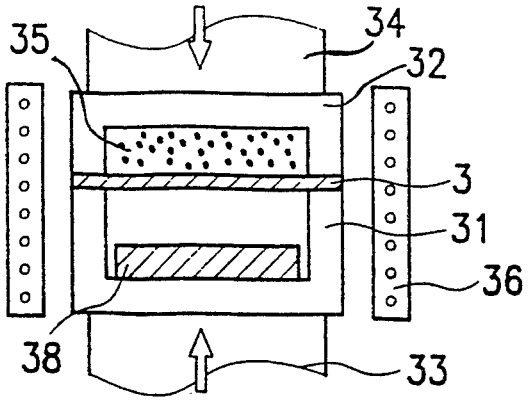
FIG. 3*a*–FIG. 3*c* are schematic diagrams showing a sheet metal blank being superplastically formed and concurrently diffusion bonded to a reinforcing plate according to an embodiment of the invention.
Figure 3B:
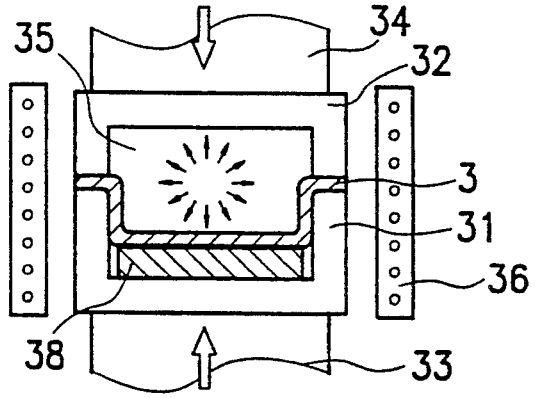
Figure 3C:
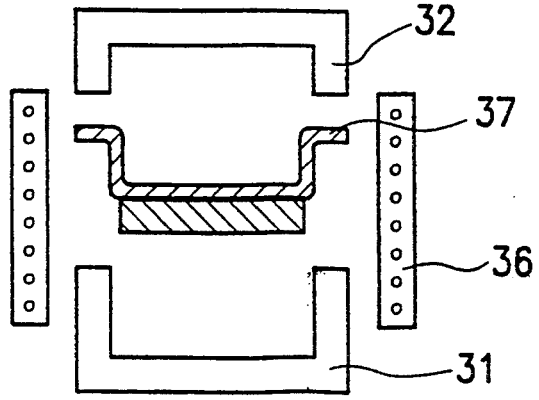

This embodiment illustrates the method for forming a metallic structure by superplastic forming with concurrent diffusion bonding. Referring now to FIG. 3*a*, a blank 3 of Ti6Al4V titanium alloy which exhibits an effective value of strain rate sensitivity at 925° C. is positioned between a first die 31 and a second die 32, and a reinforcing plate 38 to be diffusion bonded to blank 3 is provided at a fixed position of first die 31. The first die 31 is connected to a ram 33 while the second die 32 is connected to a ram 34. The blank 3 is clamped between first die 31 and second die 32 by applying pressure using rams 34, 33. As can be seen, first die 31 has a forming surface which is complementary to the shape of the finished part 37. Zinc powder 35, which can produce 50–300 psi vapor pressure at 925° C. , is preplaced in the area enclosed by blank 3 and second die 32. As can be seen from FIG. 3*b*, the blank 3 and the dies 32, 33 are then heated to 925° C. by heater 5 to vaporize zinc powder 35 to apply positive internal pressure to the blank 3 so as to deform the blank 3 against the first die 31 and into intimate contact with the reinforcing plate 38. The heating must be maintained for further 1–2 hours after the superplastic forming to assure the diffusion bonding of the reinforcing plate 38. After the metallic structure is formed, the applied pressure is reduced to ambient and the formed structures removed from the dies 31 and 32, as shown in FIG. 3*c*.

EMBODIMENT 4

Figure 4A:
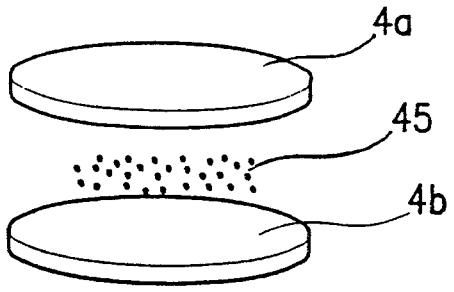
FIG. 4*a*–FIG. 4*c* are schematic diagrams showing two disk blanks being superplastically formed into a spherical body according to an embodiment of the invention.
Figure 4B:
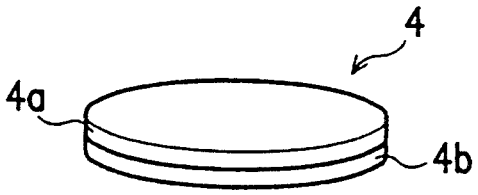
Figure 4C:
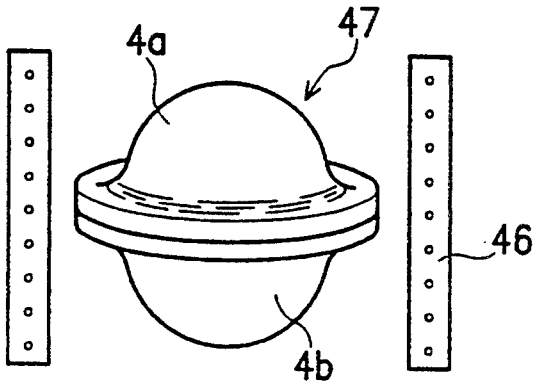

This embodiment illustrates the no-die forming of hollow spherical bodies by the superplastic forming method of the invention. Referring to FIG. 4*a*, two disk blanks 4*a*, 4*b* of superplastic material 255 stainless steel having an effective value of strain rate sensitivity at a forming temperature 1000° C. , and of same size are cut down. Zinc powder 45 capable of producing 50–300 psi vapor pressure at 1000° C. is placed between the 2 disk blanks 4*a*, 4*b*. Then as can be seen in FIG. 4*b*, the rims of the blanks are welded by arc welding to form a sealed structure 4 and is placed into a heater 46 to be heated at the forming temperature 1000° C. Zinc powder 45 vaporizes and applies positive internal pressure to the blanks 4*a*, 4*b* to form a hollow spherical body 47.

EMBODIMENT 5

Figure 5C:
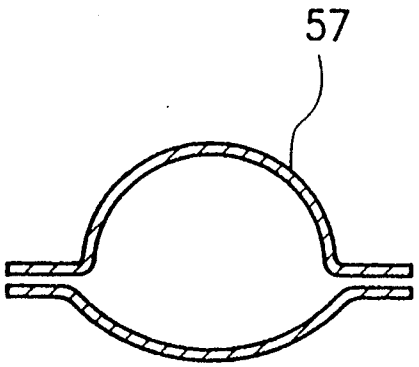
FIG. 5*a*–FIG. 5*c* are schematic diagrams showing two disk blanks being superplastically formed into a hollow body according to another embodiment of the invention.
Figure 5B:
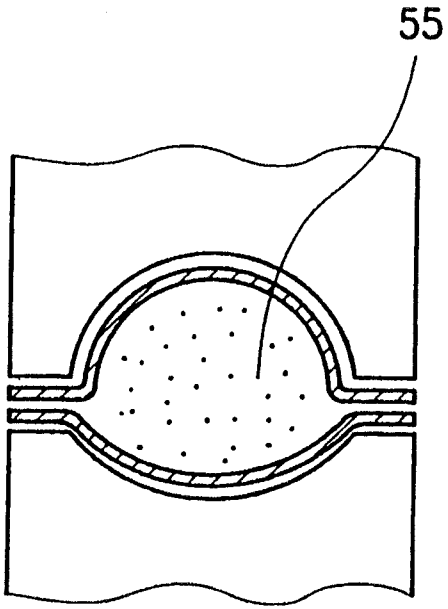
Figure 5A:
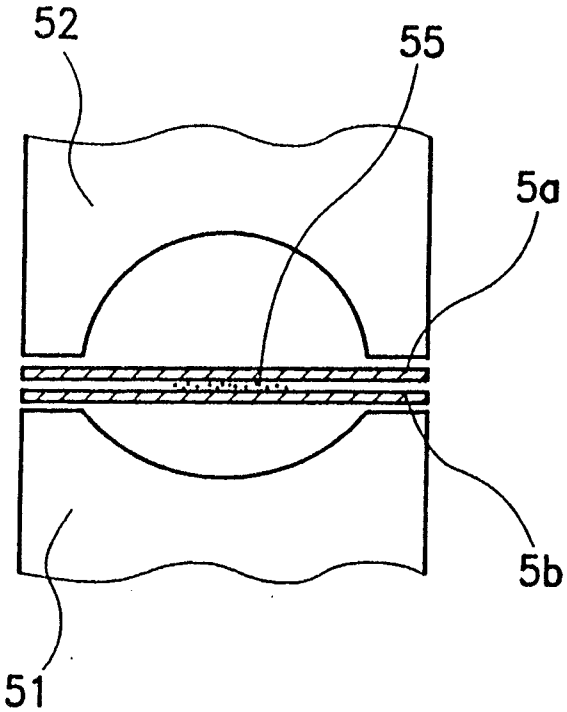

This embodiment illustrates the forming of hollow spherical bodies by using a die according to the method of the invention. Referring to FIG. 5*a*, a high gas pressure material 55 is preplaced between two disk blanks 5*a*, 5*b* of superplastic material Ti6Al4V (thickness of 1 mm, radius of 90 mm). The contacting surfaces of the two disk blanks 5*a*, 5*b* have been polished and the high gas pressure material is a mixture of $CaCO_3$ (1.7 g) and carbon powder (0.15 g). The 2 blanks 5*a*, 5*b* are positioned between a upper die 52 and a lower die 51. The upper die 52 and the lower die 51 have a hemispherical forming surface of different curvature. As can be seen from FIGS. 5*a*–5*c*, the two disk blanks are deformed into a spherical body 57 composed of two semispherical bodies of different curvature when they heated at 927° C. for 30 min.

EMBODIMENT 6

Figure 6C:
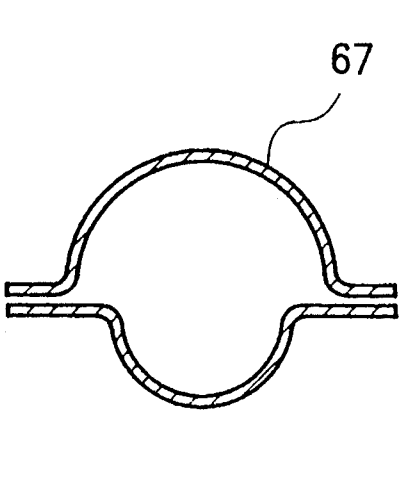
FIG. 6*a*–FIG. 6*c* are schematic diagrams showing two disk blanks being superplastically formed into a hollow workpiece composed of 2 hemispheric parts of different radius according to another embodiment of the invention.
Figure 6B:
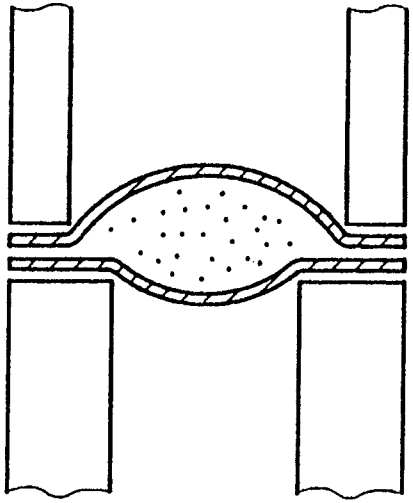
Figure 6A:
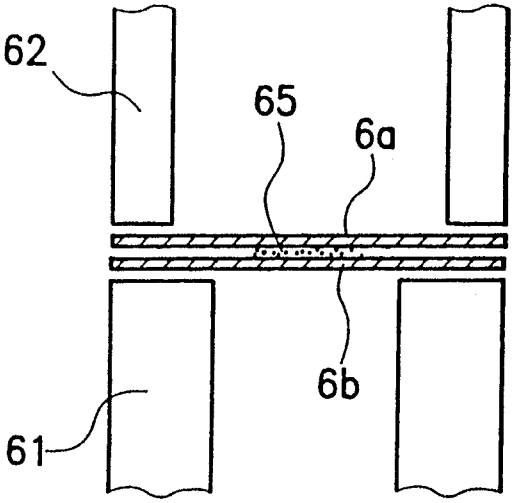
Figure 7C:
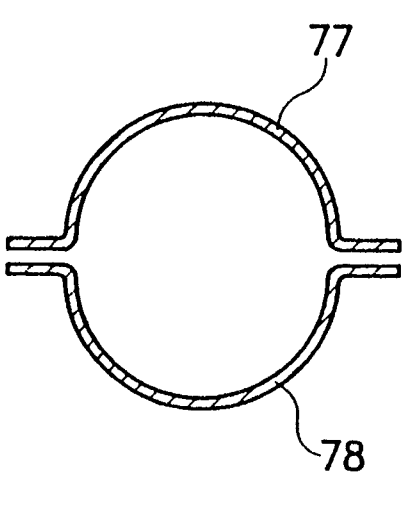
FIG. 7*a*–FIG. 7*c* are schematic diagrams showing two disk blanks being superplastically formed into 2 hemispheric parts according to another embodiment of the invention.
Figure 7B:
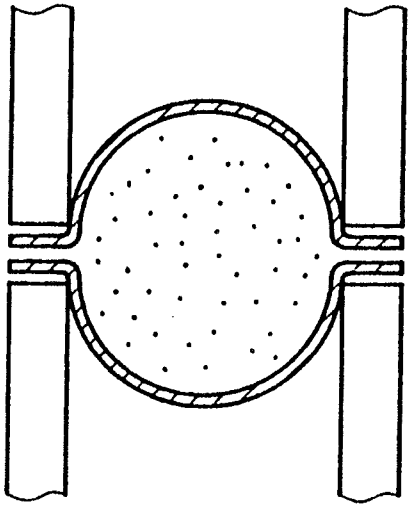
Figure 7A:
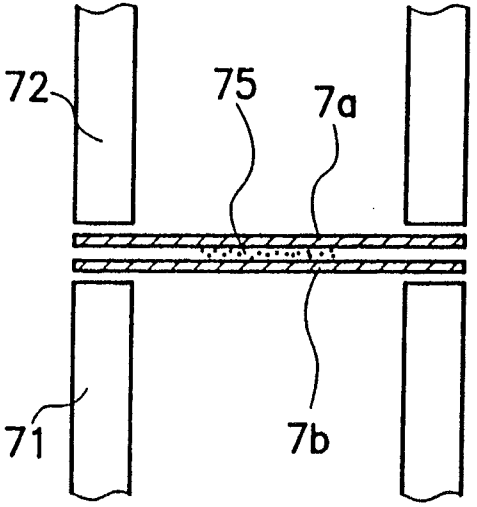

Referring to FIGS. 6*a*–6*c*, a high gas pressure material 65 is placed between two disk blanks 6*a*, 6*b* of superplastic material 255 stainless steel (thickness of 1 mm, radius of 70 mm) of the same size. The high gas pressure material 65 is a mixture 106 of 0.4 g of $CaCO_3$ and 0.04 g carbon powder, and the two disk blanks 6*a*, 6*b* are clamped by a upper clamping hollow cylinder 62 and a lower clamping hollow cylinder 61. As can be seen from FIGS. 6*a*–6*c*, the lower clamping hollow cylinder 61 has a smaller inner radius than the upper clamping hollow cylinder 62. As can be seen from FIGS. 6*a*–6*c*, the two blanks 6*a*, 6*b* are deformed into a hollow spherical body 67 when they are heated to 1010° C. for 20 minutes with their rims bonded together.

EMBODIMENT 7

Referring to FIGS. 7*a*–7*c*, 0.01 g of paraffin 75 (boiling point 370° C.) is placed between two disk blanks 7*a*, 7*b* of superplastic material 8090 Al–Li alloy (thickness of 1 mm, diameter of 38 mm) of the same size The rims of the two blanks 7*a*, 7*b* are clamped by a upper clamping hollow cylinder 72 and a lower clamping hollow cylinder 71. The upper clamping cylinder 72 and the lower clamping cylinder have the same inner radius. As can be seen from FIGS. 7*a*–7*c*, the two blanks 7*a* and 7*b* are respectively deformed into semispherical bodies 77 and 78 after they are heated to 500° C. for 20 minutes and released form the upper and lower clamping cylinders 71,72.

EMBODIMENT 8

Figure 8A:
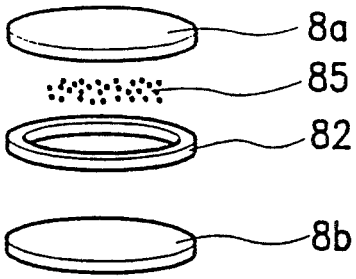
FIG. 8*a*–FIG. 8*d* are schematic diagrams showing two disk blanks and a brazing metal ring to be sandwiched between the two disk blanks being superplastically formed into a hollow spherical body according to an embodiment of the invention.
Figure 8B:
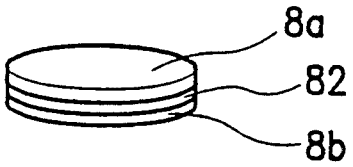
Figure 8C:
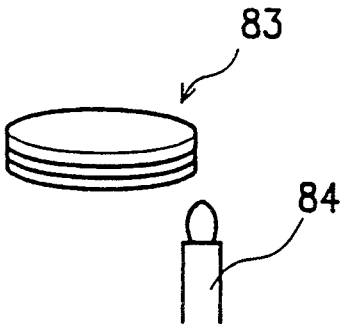
Figure 8D:
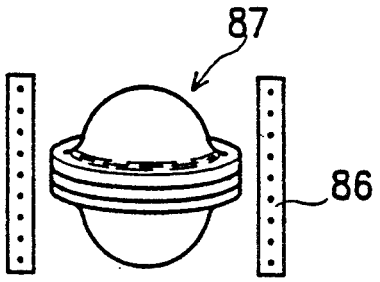

This embodiment illustrates an alternative method for forming a hollow spherical body according to the method of the invention. Referring to FIG. 8*a*, 2 disk blanks 8*a*, 8*b* of superplastic material Ti6Al6V2Sn having an effective value of strain rate sensitivity at a forming temperature 850° C. and of the same size are first cut down. Paraffin 85 capable of producing 50–300 psi vapor pressure at 850° C. is placed between the 2 disk blanks 8*a*, 8*b*. A brazing metal ring (Ti15Cu15Ni) 82 is arranged between the rims around the disk blanks 8*a*,8*b*. The rims of the blanks are then brazed by torch brazing 84 to form a sealed circular structure 83 and is placed into a heater 86 to be heated at the forming temperature 850° C. as shown in FIG. 8*c* and 8*d*. Paraffin 85 vaporizes and applies positive internal pressure to the blanks 8*a*, 8*b* to form a hollow spherical part 87.

EMBODIMENT 9

Figure 9A:
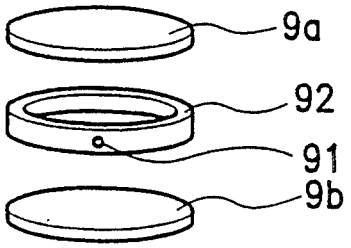
FIG. 9*a*–FIG. 9*e* are schematic diagrams showing two disk blanks and a metal ring having a hole being superplastically formed into a hollow spherical body according to an embodiment of the invention.
Figure 9B:
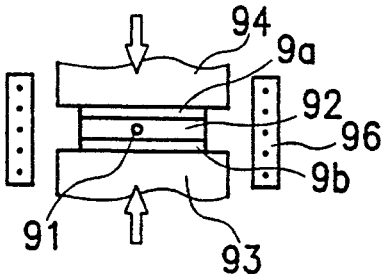
Figure 9C:
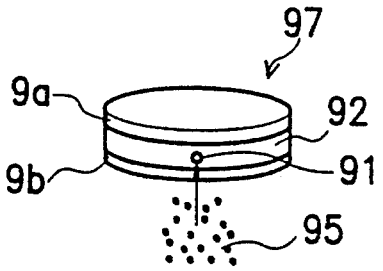
Figure 9D:
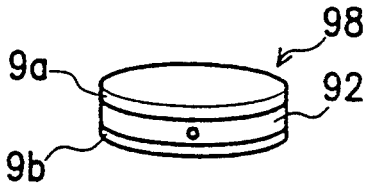
Figure 9E:
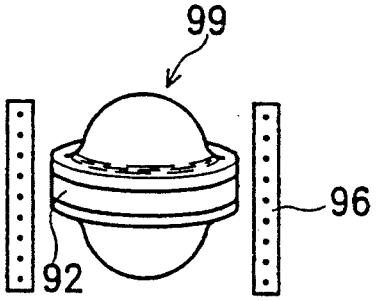

This embodiment illustrates a further method of fabricating hollow spherical bodies according to the method of the invention. Referring to FIG. 9, two disk blanks 9*a*, 9*b* of superplastic material Ti6Al4V having an effective value of strain rate sensitivity at a forming temperature 925° C. and of the same size are cut down. A 304 stainless steel metal ring 92 provided with a hole 91 thereon is placed between the two disk blanks 9*a*, 9*b* as shown in FIG. 9*a*. Then as shown in FIG. 9*b*, the metal ring 92 is sandwiched between the two disk blanks 9*a*, 9*b* to form a sandwiched structure and is clamped and diffusion bonded by a heater 96 under 10–100 $kg/mm^2$ by two rams 93, 94 at an absolute temperature degrees Kelvin of 0.6–0.8 fold of the melting point of the superplastic material Ti6Al4V 9*a*, 9*b* to form a hollow cylindrical body 97. To achieve better diffusion bonding effect, the bonding process must be kept under a pressure below $10^{-5}$ Torr for 1–2 hours. As can be seen in FIG. 9*c*, paraffin 95, which is capable of producing 50–300 psi vapor pressure at the forming temperature 925° C., is then put into the hollow cylindrical body 97 through the hole 91. Sealing the hole 91 by welding or brazing and heating the sealed hollow cylindrical body 98 at the forming temperature 925° C. produces a hollow spherical body 99.

EMBODIMENT 10

Referring to FIG. 10*a* to 10*g*, a 304 stainless steel metal ring 102 (outer radius of 28 mm, inner radius of 20 mm and height of 6 mm) is sandwiched between two disk blanks (thickness of 1 mm, radius of 28 mm) 23, 24 of superplastic material Ti6Al4V of the same size) to form a structure 108. The sandwiched structure 108 is clamped by a upper ram 104 and a lower ram 103 and subjected to diffusion bonding in a vacuum hot press at 880° C. under $10^{-5}$ Torr by applying a pressure of 800 psi for 30 minutes to form a hollow cylindrical body 107. A hole 101 is then made on the hollow cylinder body 107 and zinc powder (boiling point of 907° C.) is put into said hole. After the hole 101 is sealed by using argon welding, the hollow cylinder 107 is heated at 930° C. for 40 minutes to produce the hollow spherical body 100.

From the above description and embodiments, it is evident that the present invention has the following advantages: 1) It is not necessary to use expensive and high purity inert gas, such as argon gas, to assist the superplastic forming, allowing elimination of pipelines, controlling valves and equipment for pressurizing the gas; 2) Perfectly spherical hollow bodies can be readily produced without using a die.

What is claimed is:

1. A method for superplastically forming a part from a blank of material, comprising the steps of:

a) providing a blank workpiece of superplastic material which exhibits an effective value of strain rate sensitivity at a forming temperature;

b) providing a first die having a forming surface which is complementary to the shape of said part;

c) providing a second die capable of offering a sealed space therein with said blank workpiece;

d) positioning said blank workpiece between said first die opposite said forming surface and said second die;

e) placing a high gas pressure material capable of producing 50–300 psi gas pressure at said forming temperature between said blank workpiece and said second die;

f) clamping said dies and said blank workpiece to make said space sealed;

g) heating said blank workpiece at said forming temperature so that said high gas pressure material can produce high pressure gas and applies positive pressure to push said blank workpiece to said forming surface to form a superplastic part; and h) maintaining said positive pressure and said forming temperature for a time duration sufficient to produce the part.

2. The method as claimed in claim 1, wherein said high gas pressure material is a material selected from the group consisting of a mixture of $CaCO_3$ and carbon, zinc powder, and paraffin.

3. The method as claimed in claim 1, wherein said superplastic material is selected from the group consisting of 7475 aluminium alloy, Ti6Al4V titanium alloy, 255 stainless steel and Ti6Al6V2Sn titanium alloy.

4. A method for superplastic forming a metallic structure from a plurality of workpieces, comprising the steps of:

a) providing a blank workpiece of superplastic material which exhibits an effective value of strain rate sensitivity at a forming temperature;

b) providing a first die having a forming surface which is complementary to the shape of said part;

c) providing at least one metal workpiece to be diffusion bonded to said blank workpiece;

d) providing a second die capable of offering a sealed space therein with said blank workpiece in said first die;

e) positioning said blank workpiece between said first die opposite said forming surface and said second die;

f) placing a high gas pressure material capable of producing 50–300 psi gas pressure at said forming temperature between said blank workpiece and said second die;

g) clamping said dies and said blank workpiece to make said space sealed;

h) heating said blank workpiece at said forming temperature sufficient to produce diffusion bonding of said blank workpiece to said at least one metal workpiece so that said high gas pressure material can produce high pressure gas and applies positive pressure to push said blank workpiece to said forming surface and concurrent with diffusion bonding to form a superplastic part; and i) maintaining said positive pressure and said forming temperature for a time duration sufficient to produce the metallic structure.

5. The method as claimed in claim 4, wherein said at least one metal workpiece is a reinforcing plate.

6. A method for superplastic forming a hollow part by internal pressure, comprising the steps of:

b) providing two disk blank workpieces of superplastic material which exhibit an effective value of strain rate sensitivity at a forming temperature;

c) providing a metal ring workpiece to be diffusion bonded to said two disk blank workpieces, said metal ring work pieces has a hole formed thereon;

d) sandwiching said metal ring workpiece between said two disk blank workpieces and heating at a temperature sufficient to produce diffusion bonding of said two disc blank work pieces to said metal ring workpiece for a time period sufficient to form a hollow cylindrical body;

e) placing a high gas pressure material capable of producing 50–300 psi gas pressure at said forming temperature in said hollow cylindrical body through said hole and sealing said hole;

f) heating said hollow cylindrical body at said forming temperature to enable said high gas pressure material to produce gas to apply positive internal pressure to said disk blank work pieces of said hollow cylindrical body to form the hollow part.

7. The method as claimed in claim 6, wherein said metal ring work piece is made of material which can be diffusion bonded to said superplastic absolute material at 0.6–0.8 times the melting point temperature of said superplastic material.

8. The method as claimed in claim 6, wherein said metal ring work piece is made of said superplastic material.

9. The method as claimed in claim 6, wherein said metal ring work piece is 304 stainless steel.

10. The method as claimed in claim 6, wherein said metal ring work piece is Ti6Al4V titanium alloy.

* * * * *